United States Patent [19]

Murray

[11] 3,990,168

[45] Nov. 9, 1976

[54] PICTURE FRAME

[76] Inventor: Margarethe M. Murray, 731-1/2 Isabel St., Los Angeles, Calif. 90065

[22] Filed: June 2, 1975

[21] Appl. No.: 582,585

[52] U.S. Cl. ..... 40/152
[51] Int. Cl.[2] ..... G09F 1/12
[58] Field of Search ..... 40/152, 155; 403/294, 403/295, 402; 52/758 H, 753 D

[56] References Cited

UNITED STATES PATENTS

| | | | |
|---|---|---|---|
| 2,581,843 | 1/1952 | Edwards | 40/155 |
| 2,633,653 | 4/1953 | Angus et al. | 40/155 |
| 3,425,721 | 2/1969 | Agee | 403/294 |

*Primary Examiner*—Louis G. Mancene
*Assistant Examiner*—Wenceslao J. Contreras
*Attorney, Agent, or Firm*—Huebner & Worrell

[57] ABSTRACT

A picture frame comprised of parts for distribution in kits in which the individual frame members may be precut to size or uncut for making frames of various sizes. The individual frame members have channels on one side thereof which are engageable by resilient securing means to hold the frame members together. Wedge means are also provided to hold pictures of various thicknesses in the assembled frames.

8 Claims, 9 Drawing Figures

FIG. 1.
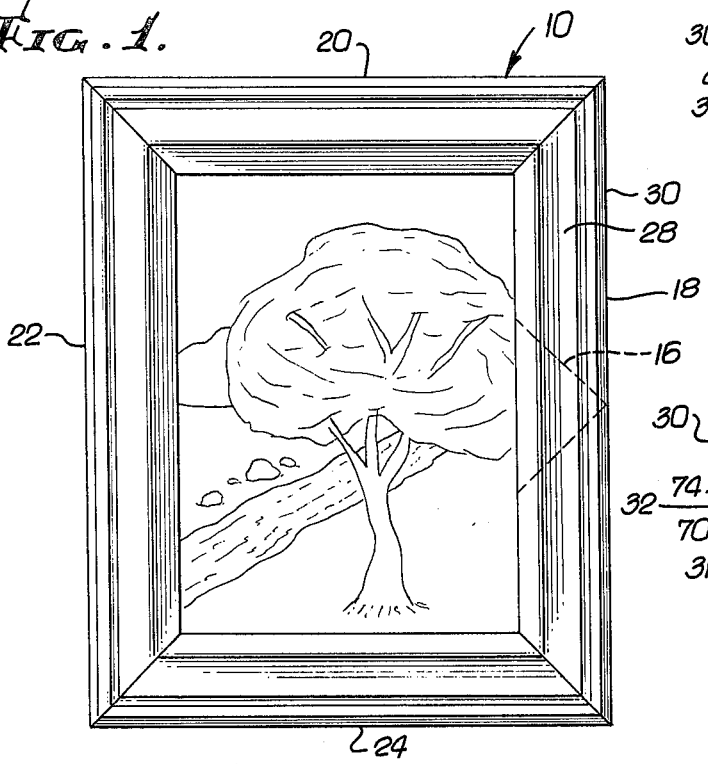
FIG. 3.
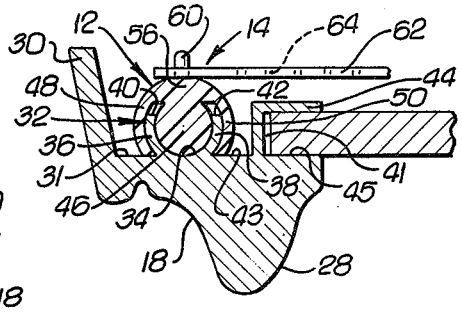
FIG. 4.
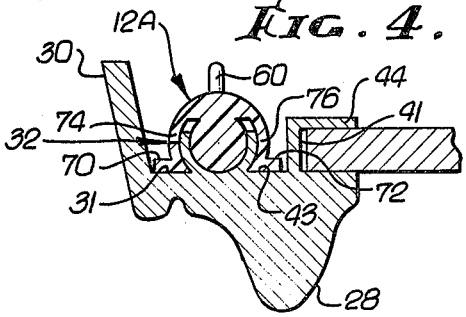
FIG. 5.
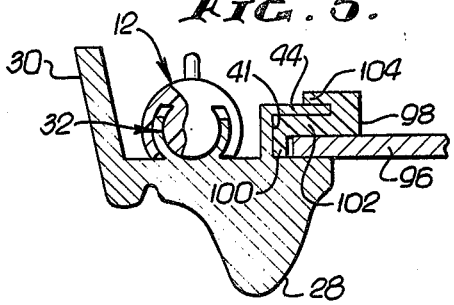
FIG. 2.
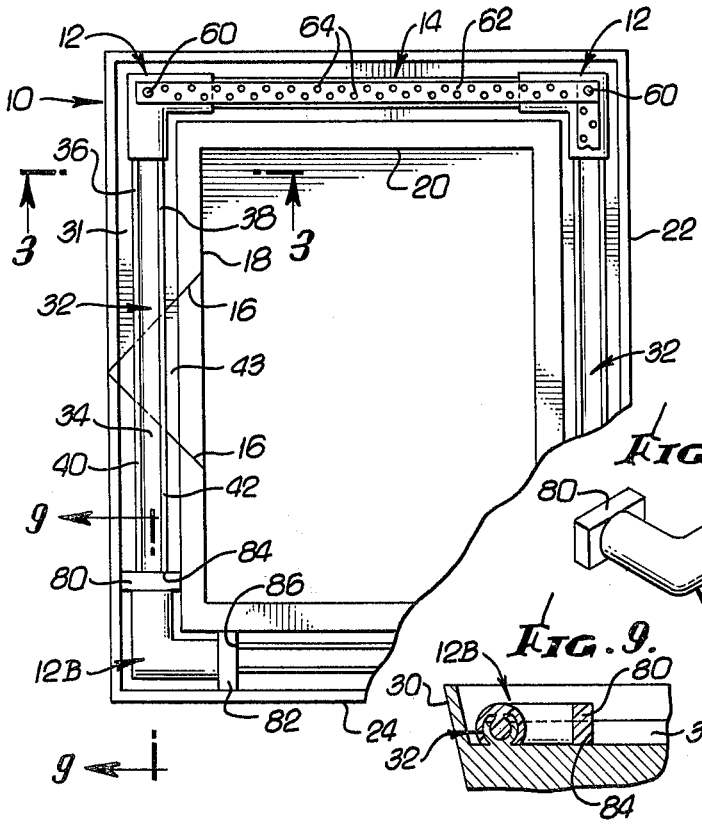
FIG. 7.
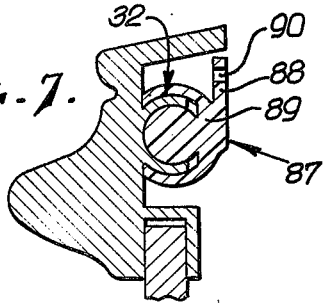
FIG. 8.
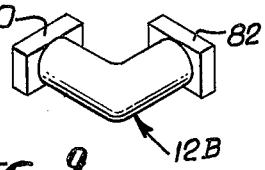
FIG. 9.
FIG. 6.
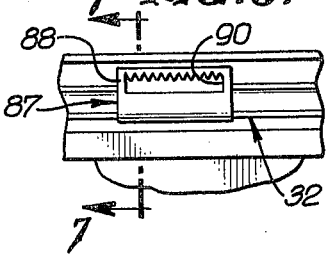

PICTURE FRAME

BACKGROUND OF THE INVENTION

The invention relates to picture frames which may be distributed unassembled in kits and which may be easily assembled by purchasers. Present kits of unassembled picture frames include instructions that suggest the use of glue, securing in a vise, and then nailing the frame members together. Many purchasers of such kits do not have a vise available. With the present invention a vise is not necessary for assembling the frame, even if gluing is desired.

In general, prior art unassembled picture frames have been made so that the assembly thereof has been rather complicated or, in the alternative, the frame structures are relatively expensive. The present invention provides inexpensive parts from which frames may be easily assembled by any purchaser.

Summary of the Invention

The frame members may be made of wood or plastic, either precut to size or marked for cutting to make frames of various sizes.

According to the invention, unique securing means are provided for engagement with individual frame members for use in permanently assembling the frames. In having the frame members available either for cutting or precut for easy assembly, the assembly cost which contributes greatly to the cost of picture frames is eliminated. The invention also eliminates the cost of elaborate packing of material, the cost of packing assembled frames, and reduces the bulk and shipping cost that occurs in the handling of assembled frames.

The present invention, because of its availability in kits, can be easily distributed in department stores, drug stores and supermarkets which normally would not sell picture frames, the area required for displaying kits being relatively small.

It is therefore an object of the invention to provide an improved picture frame which may be sold in parts unassembled and easly assembled by anyone.

It is another object of the invention to provide picture frame parts which may be easily handled, inexpensively packaged and distributed, and which may be displayed in a relatively small area in a store, particularly in comparison with assembled frames.

Further objects and advantages of the invention may be brought out in the following part of the specification wherein small details have been described for the completeness of disclosure, without intending to limit the scope of the invention which is set forth in the appended claims.

BRIEF DESCRIPTION OF THE DRAWINGS

Referring to the accompanying drawings, which are for illustrative purposes:

FIG. 1 is a front elevational view of an assembled picture frame made according to the invention;

FIG. 2 is a rear view of the frame shown in FIG. 1, illustrating several embodiments of the invention;

FIG. 3 is a fragmentary cross-sectional view taken along the lines 3—3 of FIG. 2;

FIG. 4 is a cross-sectional view illustrating another embodiment of the invention;

FIG. 5 is a cross-sectional view illustrating means for holding pictures within the frame;

FIG. 6 is a fragmentary rear view of a frame illustrating a frame hanger according to the invention;

FIG. 7 is a fragmentary cross-sectional view taken along the lines 7—7 in FIG. 6;

FIG. 8 is a perspective view of another embodiment of a means to secure the frame members together; and FIG. 9 is a cross-sectional view of the embodiment shown in FIG. 8 and taken along the lines 9—9 in FIG. 2.

DESCRIPTION OF THE PREFERRED EMBODIMENTS

Referring again to the drawings, there are shown in FIGS. 1–3 a frame, generally designated as 10, and made according to the invention, illustrating means, generally designated as 12 and 14, for securing the frame members together. In FIGS. 1 and 2 the frame is shown assembled in its complete form, illustrating cutting marks 16 which may be put on uncut individual frame members, as 18, 20, 22 and 24, in their manufacture to indicate cutting locations for various sizes.

The structure of the frame members, as 18, is best seen in FIG. 3 where the frame is shown to have a curved front face 28 and a flat side wall 30. Each frame member is typically cut at 45° angles at its ends to form a right angle corner.

Spaced laterally inwardly from the side wall 30 by a back wall portion 31 in each frame member is an elongated channel, generally designated as 32, conveniently coextensive in the elongated direction with the frame member. Each channel is comprised of a curved interior surface formed on a bottom 34 and two walls 36 and 38. The walls diverge adjacent and away from their bottom and converge at their outer ends 40 and 42. The exterior surfaces of the walls correspond to the interior surfaces.

Laterally inwardly of the channel is a back wall surface 43 and from which extends a laterally inwardly opening groove or channel 41 formed between a back leg 44 and a laterally extending surface 45.

Each frame securing means 12, made of resilient material, is defined as a right angle member adapted to be snap-fitted into engagement from the back with the channels 32 of two adjacent frame members, as 18 and 20, fitted together along their 45° angles to form a 90° corner. Securing means 12 has an elongated inner central portion 46 forming a right angle and being generally cylindrical in cross section, adapted to fit snugly within the channels 32 defining a right angle. Spaced outwardly from the inner portion 46 are legs 48 and 50 snap-fitted in gripping engagement on and over the respective channel legs 36 and 38, the legs having curves that are substantially concentric with the curves of the portion 46.

The ends of the legs 48 and 50 fit in abutment with frame surfaces 31 and 43. Joining the legs 48, 50 with the inner portion 46 is an outer part 56. A securing member 12, engaged as shown, holds each pair of adjacent frame members together in a properly fitting and secure manner.

To provide additional holding means a pin 60 may be molded or otherwise secured centrally with respect to the right angle to extend outwardly from each securing member. As shown in FIGS. 2 and 3, a tape 62 having a multiplicity of holes 64 is positioned, engaged with the two pins 60, each pin extending through a hole at opposite ends of the tape. The tape may be of any length and cut to fit.

Another embodiment of the invention is shown in FIG. 4 in which a corner securing member, generally designated as 12A, is distinguished from the member 12 by having a pair of laterally extending feet 70 and 72 extending from the legs 74 and 76 of the securing member. The feet provide additional gripping means to aid in holding the frame members together.

In FIGS. 2, 8 and 9 another embodiment of a securing means, generally designated as 12B, is shown. The member 12B is the same as the member 12, except that it does not have a pin 60 and at its ends it has laterally extending protrusions or T forming members 80 and 82, adapted to fit in transverse slots 84 and 86, made by removal of a portion of the channel walls 36 and 38 of the frame. The fitting of the protrusions 80 and 82 into the transverse slots provide additional means holding the adjacent frame members together.

In FIGS. 6 and 7 a hanger, generally designated as 87, is shown engaged centrally within the frame in an upper member there of in a channel 32. The hanger 87 has the same configuration as the securing member 12 with respect to fitting within and around the channel 32. It has a flattened outer part 89, and extending therefrom, substantially at right angles thereto is a flat member 88 having an elongated transverse opening 90 therein. As shown in FIG. 6, the opening has serrations forming its upper inner surfaces for adjustable engagement with a hanging nail.

As shown in FIG. 5, in order to secure a relatively thin picture 96 in the wider groove 41, wedge means 98 are inserted between the groove wall 44 and the picture board or canvas 96. The wedge means 98 has an inner leg 100 which fits on the groove bottom, a laterally extending leg 102 fitting between the picture and the groove wall, and a snugly overlapping leg 104 fitting on the outside of the groove wall. The picture is inserted into the frame as it is being assembled.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific form shown or uses mentioned except as defined in the accompanying claims, wherein various portions have been separated for clarity of reading and not for emphasis.

I claim:

1. A picture frame comprising:

frame members adapted to be joined at their ends, longitudinal channels on each of said frame members being in joining alignment at the frame member ends with channels on adjacent frame members, said channels to open rearwardly from the frame members and having legs extending away from the frame members, means being in securing engagement with said joining aligned channels securing said frame members together adjacent their ends, said securing means having an inner portion thereof in securing engagement within said channels and having outer portions thereof in securing engagement with the exteriors of said channel legs.

2. The invention according to claim 1 in which:

said channels each have curved inner wall surfaces formed on the channel bottom and on the interior of the legs, said channel legs having curved outer wall surfaces corresponding to the inner leg surfaces.

3. The invention according to claim 2 in which:

said inner portion of said securing means within each channel is elongated and has a curved cross section to fit snugly therein, said outer portions extending laterally from said inner portion on opposite sides thereof, said outer portions being legs spaced from the inner portion and fitting snugly outwardly on said channel legs and substantially coextensive therewith in the direction toward said frame member, said securing means being of resilient material.

4. The invention according to claim 3 in which:

said legs on said securing means having laterally extending feet outwardly of both sides of each channel.

5. The invention according to claim 4 in which said frame members have 45° angles at their ends and are joined forming right angles, said securing means having a right angle corner and each part thereof forming the right angle being engaged with respective adjacent joining channels of the frame members.

6. The invention according to claim 5 in which:

each right angle securing means has a pin extending outwardly therefrom away from the frame members, said pin being positioned centrally with respect to the angle, and strips of material having holes therethrough extending along said frame members, holes in each strip adjacent the ends thereof being engaged with respective pins to further secure said frame members together.

7. The invention according to claim 2 in which:

said channels are coextensive with said members; and a picture hanger secured on one of said channels, said channel being on the back side of said frame, hanger securing means extending from said hanger engaging said channel, said hanger securing means having an inner portion in securing engagement within said channel and having outer portions in securing engagement with exteriors of said channel legs, said securing means being of resilient material.

8. The invention according to claim 7 in which:

said inner portion of said hanger securing means is elongated and has a curved cross section fitting snugly in the channel, said outer portions of said hanger securing means extending laterally from said inner portion thereof, said outer portions of said hanger securing means being legs spaced from the inner portion thereof and fitting snugly outwardly on said channel legs and substantially coextensive therewith in the direction toward said frame member.

* * * * *